US007156540B2

(12) United States Patent
Haines

(10) Patent No.: US 7,156,540 B2
(45) Date of Patent: Jan. 2, 2007

(54) LIGHTING FIXTURE INCLUDING TWO REFLECTORS

(76) Inventor: Christopher Alan Haines, 20 Woodcliffe Rd., Lexington, MA (US) 02421

( * ) Notice: Subject to any disclaimer, the term of this patent is extended or adjusted under 35 U.S.C. 154(b) by 0 days.

(21) Appl. No.: 10/508,248

(22) PCT Filed: Mar. 20, 2003

(86) PCT No.: PCT/AU03/00327

§ 371 (c)(1),
(2), (4) Date: May 27, 2005

(87) PCT Pub. No.: WO03/078891

PCT Pub. Date: Sep. 25, 2003

(65) Prior Publication Data

US 2005/0225972 A1 Oct. 13, 2005

(30) Foreign Application Priority Data

Mar. 20, 2002 (AU) ..... PS1193

(51) Int. Cl.
*F21V 7/00* (2006.01)

(52) U.S. Cl. ..... 362/298; 362/217; 362/346; 362/297; 362/260

(58) Field of Classification Search ..... 362/217, 362/347, 346, 297, 298, 260, 302
See application file for complete search history.

(56) References Cited

U.S. PATENT DOCUMENTS 4,310,876 A * 1/1982 Small et al. ..... 362/298
5,249,110 A * 9/1993 Russello et al. ..... 362/294
2003/0002280 A1* 1/2003 Paravantsos ..... 362/223

OTHER PUBLICATIONS

DE 4,125,545 to Schmidt, Hans J., issued Feb. 20, 1992.*

* cited by examiner

*Primary Examiner*—Laura K. Tso
(74) *Attorney, Agent, or Firm*—O. M. (Sam) Zaghmout; Bio Intellectual Property Services (Bio IPS) LLC

(57) ABSTRACT

A luminaire optical system (10) for an indirect light source including a tubular lamp (12) having a longitudinal axis (22), a first reflector assembly (14) extending parallel to and radially spaced directly above said lamp and a second reflector assembly (16) parallel to and radially spaced from said lamp directly below the lamp. Each of the assemblies includes symmetrical reflectors (22; 24; 30; 32) joining in an apex (26; 34) directly below and above the lamp. The bottom reflector (16) further may include two segments (30*a;* 30*b;* 32*a;* 32*b*) on each reflecting surface, the segments marking a sharp change in reflecting angle. Most such luminaires will typically also include perforations to maintain useful light profiles. The luminaire according to the present configuration increases the lighting efficiency by minimising any reflections passing back into the tube and ensuring an even spread of light throughout an area being illuminated.

20 Claims, 4 Drawing Sheets

LIGHTING FIXTURE INCLUDING TWO REFLECTORS

The present invention relates to a lighting fixture and in particular to a lighting fixture for a fluorescent lamp which is suspended from or mounted on a ceiling above an area to be illuminated.

BACKGROUND OF THE INVENTION

There are typically two types of light sources, those that emanate from a single point source like incandescent globes, and those that emanate from linear sources such as fluorescent tubes.

Linear type light sources generally provide a broader area of illumination than do point sources of equal intensity and numerous luminaires or fixtures using linear type light sources have come into existence, especially those that house fluorescent tubes. Typically these are mounted in ceilings although wall mounted luminaires have also come into existence. The fixture mounted on the ceiling includes a housing having two ends, in between which is suspended a fluorescent tube. Since one of the difficulties experienced in such an arrangement is that there is a high glare factor, that is, the light emanating directly from the tube is bright compared to the surroundings, most such fixtures simply alter the direct light by diffusion through a lens or by diffuse reflection. Whilst this overcomes the problems of glare, a high percentage of the total light is lost, with the efficiencies of some of the luminaires being below 50%.

Some luminaires propose reflecting the light above the tube towards the ceiling. This arrangement does provide indirect ceiling light but is still relatively inefficient and results in uneven downward light illumination.

Other luminaires include curved or angled inner surfaces that spread the light more broadly generally upwardly but the distribution of light is still limited by the rectangular perimeter of the housing. Yet others cause the light to be distributed at generally low angles to the ceiling that also does not provide a even distribution of light.

Accordingly, the applicant is not aware of any luminaire that is highly efficient, and maintains a broad area of illumination generally below the luminaire.

It is an object of the present invention to propose a luminaire that overcomes at least some of the abovementioned problem or provides a useful alternative to luninaires currently known.

It is a further object of the present invention to propose a luminaire that maximises efficiency and provides good glare control.

SUMMARY OF THE INVENTION

Therefore in one form of the invention there is proposed a luminaire optical system for an indirect light source including:

a tubular lamp having a longitudinal axis;

a first reflector assembly extending generally parallel to and spaced above said lamp, said first reflector assembly including a pair of first reflectors joined to form a first apex;

a second reflector assembly extending generally parallel to and spaced below said lamp, said second reflector assembly including a pair of second reflectors joined to form a second apex, each of said second reflectors including two arc segments joined at a middle apex; and wherein said first apex, said second apex and lamp longitudinal axis are axially aligned along a first plane.

In a further form of the invention there is proposed a luminaire optical system for an indirect light source including:

a tubular lamp having a longitudinal axis;

a first reflector assembly extending generally parallel to and spaced above said lamp, said first reflector assembly including a pair of first reflectors joined to form a first apex;

a second reflector assembly extending generally parallel to and spaced below said lamp, said second reflector assembly including a pair of second reflectors joined to form a second apex wherein said first apex, said second apex and lamp longitudinal axis are axially aligned in a first plane; and each of said second reflectors including a second distal edge on opposed sides of said second apex, each of said second distal edges and said lamp longitudinal axis defining planes intersecting said first plane at substantially 90 degrees on either side of said first plane.

In preference said first plane is substantially vertical.

In preference said first reflectors are symmetrical about said first apex.

In preference said second reflectors are symmetrical about said second apex.

Preferably each of said first reflectors includes a first distal edge on opposed sides of said first apex, each of said first distal edges and said lamp longitudinal axis defining planes intersecting said first plane at substantially 70 degrees on either side of said first plane.

Preferably each of said second reflectors includes a second distal edge on opposed sides of said second apex, each of said second distal edges and said lamp longitudinal axis defining planes intersecting said first plane at substantially 90 degrees on either side of said first plane.

In preference each of said second reflectors includes two arc segments joined at a middle apex.

In preference said middle apex and said lamp longitudinal axis of each of said second reflectors define a plane intersecting said first plane at substantially 45 degrees on either side of said first plane.

Preferably said luminaire optical system includes a housing adapted to hold said lamp, first reflector assembly and second reflector assembly in fixed relationship thereto.

Preferably said housing is adapted to suspend from a ceiling.

Preferably said second reflectors include translucent areas.

Preferably said second reflectors include perforated areas.

Preferably said tubular lamp is a tube having a diameter of ⅝ inches (equivalent to approximately 1.5875 cm).

Preferably said first reflector assembly first apex is positioned some 1 and ¾ inches (equivalent to approximately 4.445 cm) from said tube longitudinal axis.

Preferably said second reflector assembly second apex is positioned some 1 and ⅛ inches (equivalent to approximately 2.8575 cm) from said tube longitudinal axis.

In preference said first reflector assembly has a footprint substantially greater than said second reflector assembly.

In preference the reflection angle of said first reflectors is some 70 degrees from vertical at the first apex and some 125 degrees from vertical at said first distal edge.

In preference the reflection angle of said second reflectors is some 117.5 degrees from vertical at the second apex and some 11.25 degrees at said second distal edge.

In preference said middle apex is generally in the range of some 3–40 degrees.

Although the above description related to a linear light source it is to be understood that the present invention could equally well be applied to a point light source. In such an arrangement the bottom and top reflectors would instead of being of a linear configuration be of a circular configuration.

Furthermore it is to be understood that in the case of a linear source that the housing need not have two ends whose purpose is to provide the support of the tube, but that the housing simply be able to support the tube above an area to be illuminated. It may therefore be that a suitable design may even include a one-end support.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 1:
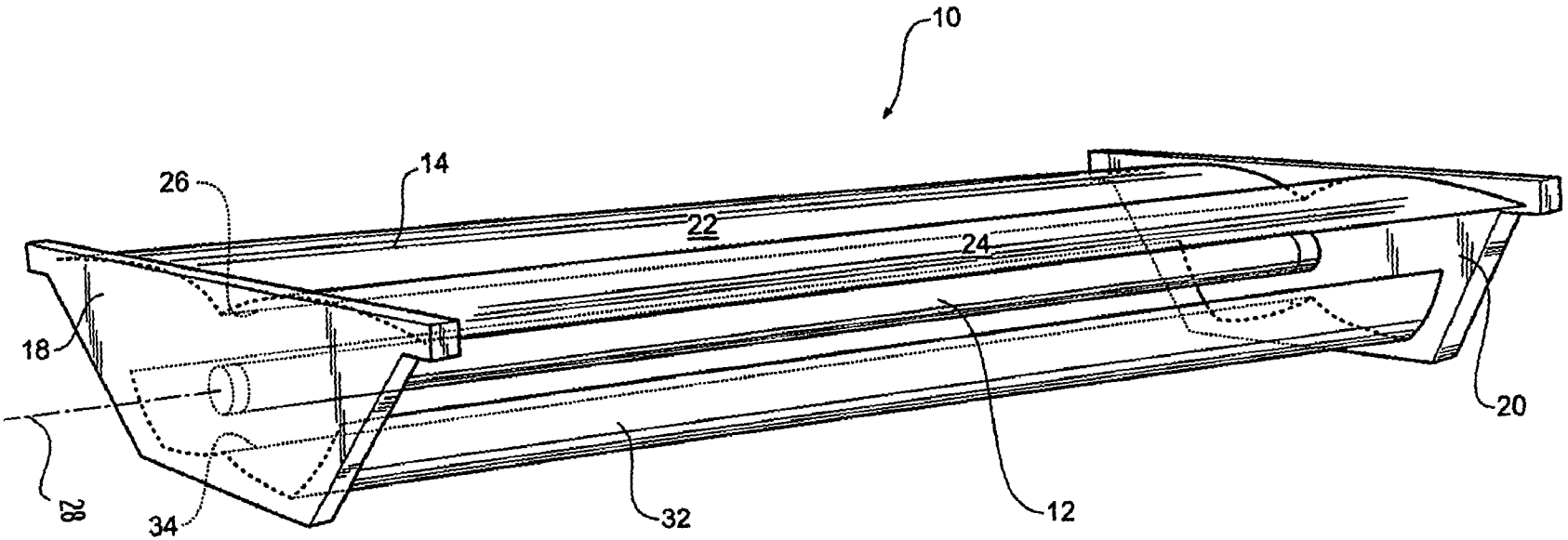
FIG. 1 is a perspective schematic view of a luminaire embodying the present invention.
Figure 2:
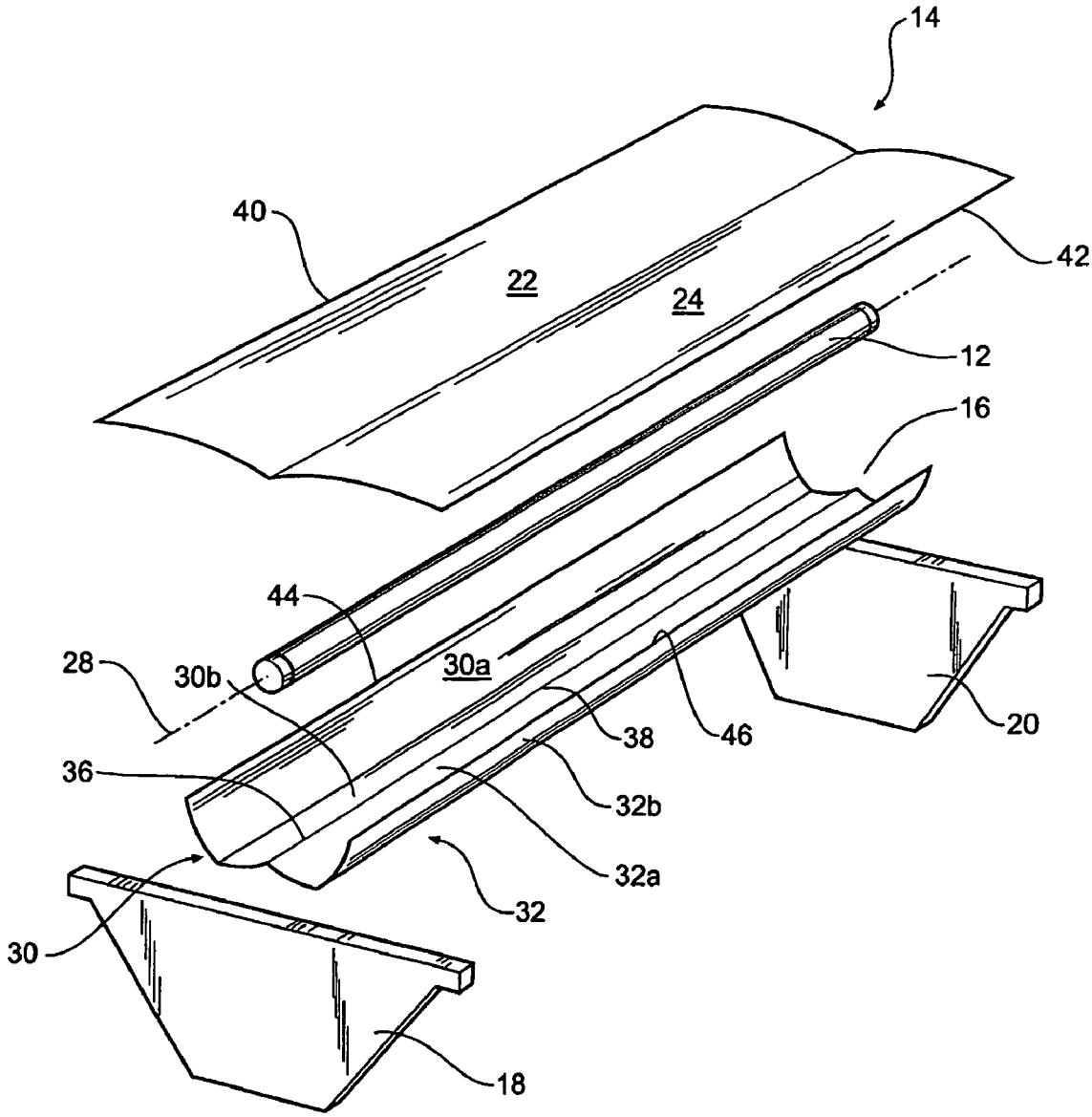
FIG. 2 is an exploded perspective view of the luminaire of FIG. 1.
Figure 3:
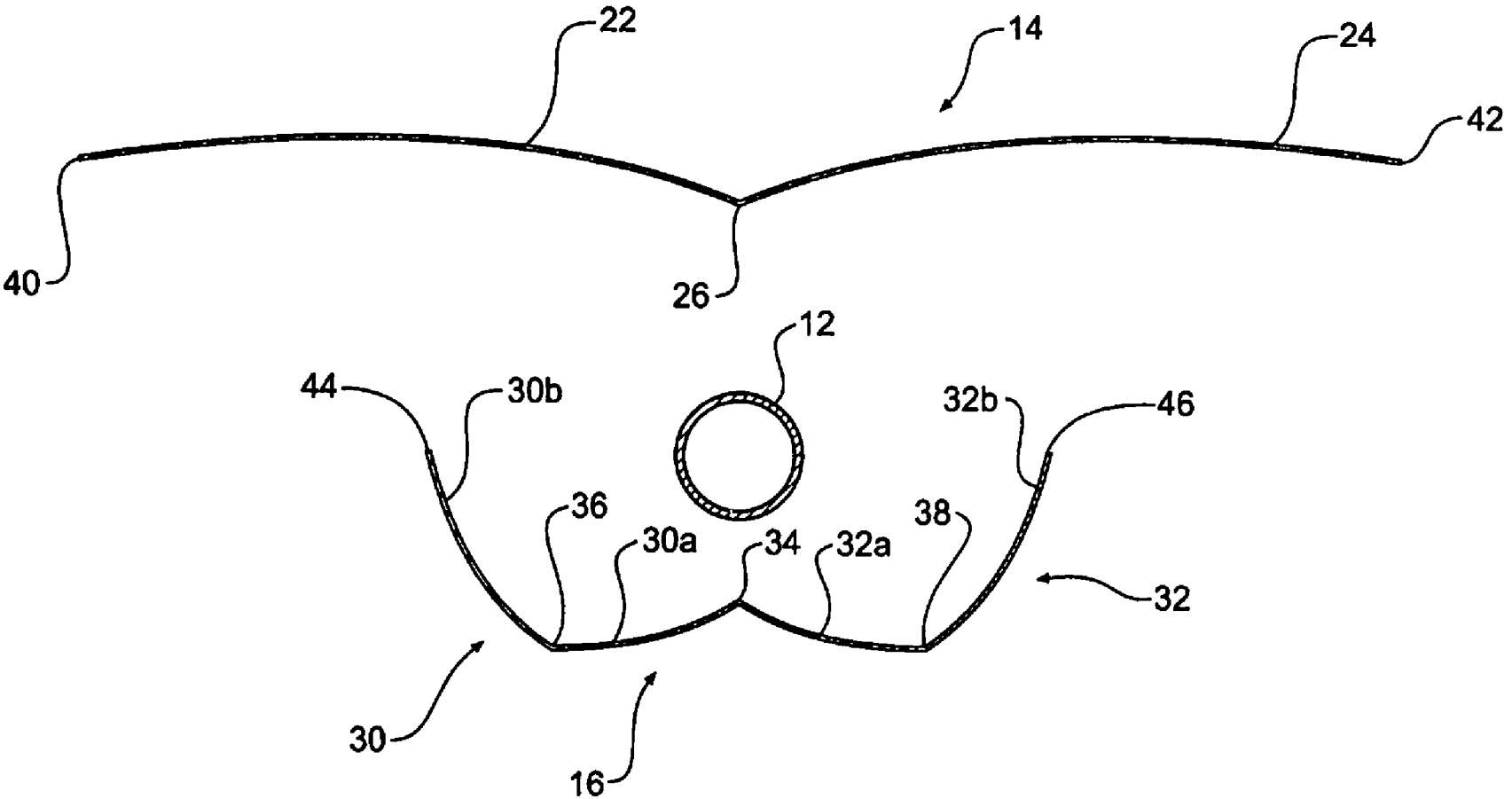
FIG. 3 is a cross-sectional view of the luminaire of FIG. 1.

Referring now to the drawings and in particular to FIGS. 1 to 3, there is shown simplified schematic views of a lighting fixture or luminaire 10 including a tube 12 a first reflector assembly 14 and a second reflector assembly 16. Sides 18 and 20 located on opposite ends of the luminaire are used to keep the structure integral and to, for example, suspend the luminare from the ceiling.

The first reflector assembly 14 is positioned above the tube 12 and includes two parabolic reflectors 22 and 24 joined at first apex 26, the first apex 26 positioned generally directly above the longitudinal axis 28 of the tube 12.

The second reflector assembly 16 is positioned directly below the tube 12 and includes two reflectors 30 and 32 joined at a second apex 34, the second apex 34 positioned generally directly below the longitudinal axis 28 of tube 12.

It will now be readily apparent to the reader that the first apex 26, longitudinal axis 28 and second apex 34 all lie on a first plane, the plane being generally vertical when one is considering a luminaire that is mounted to or hung from a ceiling. Although not shown it is to be understood that the luminaire is generally mounted to the ceiling by appropriate fixing means and includes the necessary electrical components including power supply and ballast.

Typically the reflector assemblies are symmetrical. However, when the luminare may be applied to an atypical situation, such as being mounted proximate a wall, where one is desirous of maintaining efficiency in one direction only and gently illuminating a wall in the other, the assemblies may in fact not be symmetrical but will be modified to accommodate the particular situation.

The footprint of the first reflector assembly 14 is substantially greater than the second reflector assembly 16 so that light that is produced by the tube 12 is reflected predominantly downwards.

Both the first apex 26 and the second apex 34 ensure that emitted light from the tube 12 is substantially reflected outwardly from the luminaire 10 or at least towards one of the reflecting surface assemblies rather than being reflected back into the tube 12 where it would be lost thus reducing the total illumination efficiency of the luminaire. Thus, it is the relative geometry of the luminarie that will achieve this result with each configuration having a unique solution, but each configuration having at the very least a first refector assembly with a larger footprint than the second and each assembly having an apex that lies directly below or above the tube. One particular configuration will be discussed shortly.

Those skilled in the art will appreciate that this size differential results in a larger percentage of light being reflected generally downwardly whether reflected straight from the tube 12 or whether it is a primary or secondary reflection after light has first been reflected from reflector assembly 14. The skilled addressed will now also appreciate that to minimise total light intensity loss one wants to minimise total reflections that a light ray may undergo prior to propagating generally downwardly out of the luminarie. The use of the first and second reflector assemblies means that with the right geometrical shape of the reflectors the substantial percentage of light goes through not more than two such reflections. Theoretically it may even be possible that all of the light goes through no more than two reflections, much depending on the accuracy of the manufacturing process.

This is further aided by each of the reflecting surfaces 30 and 32 of the second reflector assembly 16 being composed of two arc segments, surface 30 comprising segments 30*a* and 30*b* and surface 32 comprising segments 32*a* and 32*b*. The segments 30*a* and 30*b* join in a middle apex 36, segments 32*a* and 32*b* join in middle apex 38. The middle apex changes the angle of reflection quite markedly by a figure approaching some 50 degrees.

The distal edges 40 and 42 of the first reflectors 22 and 24 respectively of the first reflector assembly extend substantially horizontally above the tube 12 so that the distal edges and said tube longitudinal axis define planes intersecting said vertical plane at substantially 70 degrees on either side of the vertical plane.

The distal edges 44 and 46 of the second reflectors 30 and 32 respectively of the second reflector assembly extend below the tube 12 so that the distal edges and said tube longitudinal axis define planes intersecting said vertical plane at substantially 90 degrees on either side of the vertical plane. This ensures that there is no direct downwards light from the tube that would result in glare.

The apex is positioned at 45 degrees to the tube, that is, the middle apex and lamp longitudinal axis define a plane intersecting said vertical plane at substantially 45 degrees on either side of the vertical plane.

Figure 4:
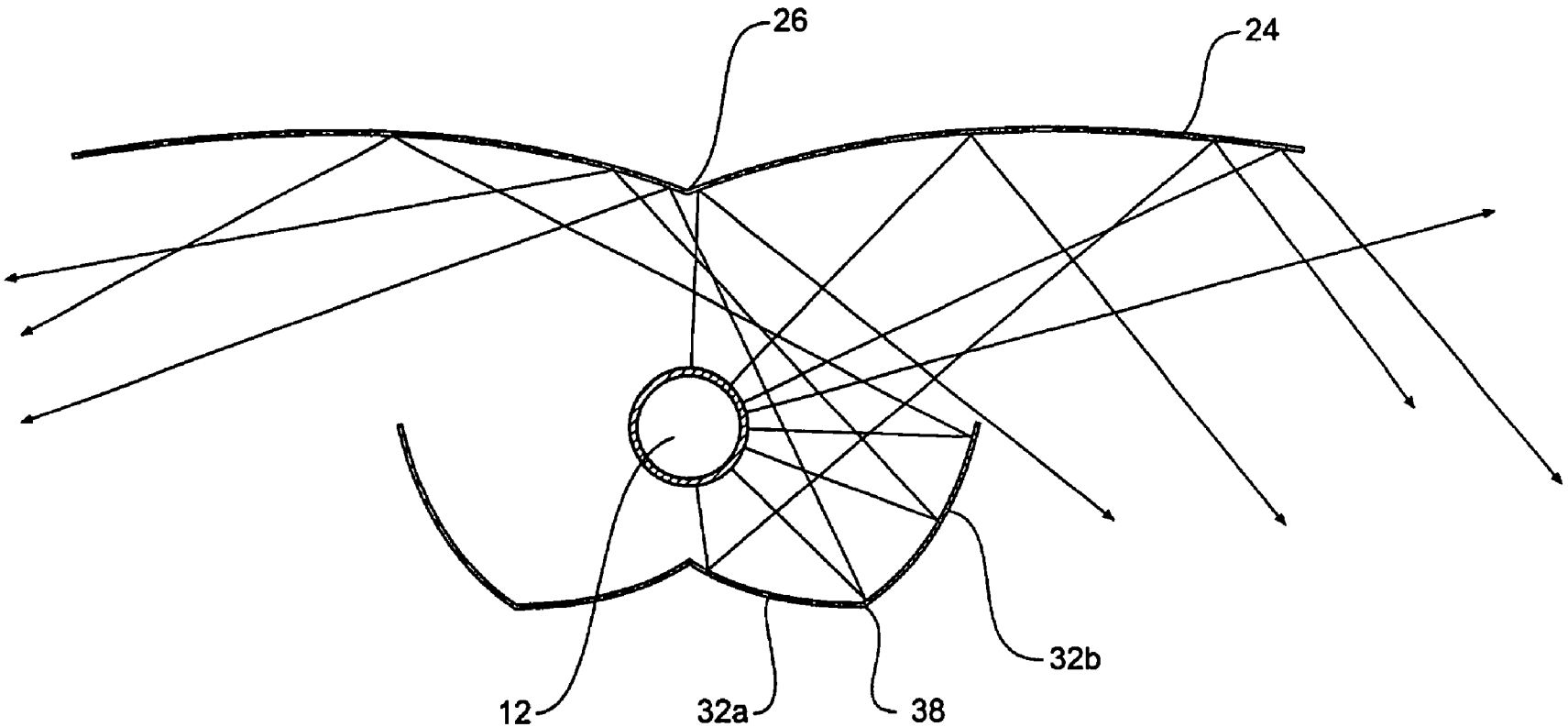
FIG. 4 is a cross-sectional view as in FIG. 3 but illustrating the reflection of individual light rays.

When referring to FIG. 4, the reader can now appreciate that the particular geometric configuration of the reflector assemblies leads to very little, if any, of the reflected light passing back through the tube thus increasing the efficiency of the luminaire.

In the particular case when one is using a T5 type tube the following table provides approximate geometrical estimates of the surface angles at various angles form the vertical plane. This assumes that the first reflection assembly is some 1 and ¾ inches above the tube centre whilst the bottom reflector is some 1 and ⅛ inch below.

| Top reflector | |
|---|---|
| Angle from lamp | Reflector surface angle from vertical |
| 0° | 70° |
| 25° | 0° |
| 50° | 115° |
| 70° | 125° |

It is to be understood that the curvature in between the angles above is of a smooth transitional type with no sudden angle changes. Accordingly in most instances the curvature would vary in the range of some 0.5° to 1° with every degree change in the angle from the tube.

| Bottom reflector | |
|---|---|
| Angle from lamp | Reflector surface angle from vertical |
| 0° | 117.5° |
| 5° | 112.5° |
| 20° | 105° |
| 25° | 100° |
| 30° | 97.5° |
| 45° | Apex angle around 30°–35° |
| 50° | 51.25° |
| 90° | 11.25° |

In the case where the tube is of a different diameter, or where one wishes for a different light distribution, the sizes, distances, and curvature of the reflectors may be changed to accommodate the situation.

In cases where there may be a need for greater direct downward illumination, one may include apertures or slits in the bottom reflector where some radiated light projected downwardly is not reflected through any surface. A reflector may include a mixture of circular apertures and longitudinal slits distributed in a pattern through the reflector.

Those skilled in the art will now appreciate that use of reflectors symmetrically disposed below and above the tube wherein the top reflector is of a greater cross-sectional size than the bottom one and where the curvature of the two reflectors is relatively chosen results in a luminaire with a greater light efficiency than hitherto known.

The reflectors are typically coated with a reflecting surface having a high efficiency of reflection and that acts as a mirrored surface. However those skilled in the art will appreciate that the surfaces of the reflectors may include different coatings and/or filters that may not only control the reflection percentages but also change its characteristic. The reflecting surface may also include individual micro specular reflectors whose orientation may vary slightly to achieve a more homogenous distribution of light.

One can now appreciate that the present invention teaches the use of upper and lower reflectors with high reflectivity and specular reflective surfaces that are designed to interdependent geometry that maximises efficiency by minimising light loss and the number of reflections required to exit the fixture while providing good glare control by covering the tube form view.

The lower reflector is generally perforated to avoid contrast at the reflector edge and to provide a good light output profile. The concept is adapted to any diameter tube and to general or specific purpose fixture as well as other types of light source.

As discussed above it is to be understood that the present invention can be applied to a point light source. In such an arrangement, the reflectors assume a circular symmetry instead of the linear symmetry as discussed above.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but embraces all equivalent devices and apparatus.

The invention claimed is:

1. A luminaire optical systems for an indirect light source including:

a tabular lamp having a longitudinal axis;

a first reflector assembly extending generally parallel to and spaced above said lamp, said first reflector assembly including a pair of first reflectors joined to form a first apex; a second reflector assembly extending generally parallel to and spaced below said lamp, said second reflector assembly including a pair of second reflectors joined to form a second apex, each of said second reflectors including two arc segments joined at a middle apex; and wherein said first apex, said second apex and lamp longitudinal axis are axially aligned along a first plane.

2. A luminaire optical system for an indirect light source including:

a tubular lamp having a longitudinal axis;

a first reflector assembly extending generally parallel to and spaced above said lamp, said first reflector assembly including a pair of first reflectors joined to form a first apex; a second reflector assembly extending generally parallel to and spaced below said lamp, said second reflector assembly including a pair of second reflectors joined to form a second apex wherein said first apex, said second apex and lamp longitudinal axis are axially aligned in a first plane; and each of said second reflectors including a second distal edge on opposed sides of said second apex, each of said second distal edges and said lamp longitudinal axis defining planes intersecting said first plane at substantially 90 degrees on either side of said first plane.

3. A luminaire optical system as in any one of claims 1 or 2 wherein said first plane is substantially vertical.

4. A luminaire optical system as in claim 1 wherein said first reflectors are symmetrical about said first apex.

5. A luminaire optical system as in claim 1 wherein said second reflectors are symmetrical about said second apex.

6. A luminaire optical system as in claim 1 wherein each of said first reflectors includes a first distal edge on opposed sides of said first apex, each of said first distal edges and said lamp longitudinal axis defining planes intersecting said first plane at substantially 70 degrees on either side of said first plane.

7. A luminare optical system as in claim 1 wherein each of said second reflectors includes a second distal edge on opposed sides of said second apex, each of said second distal edges and said lamp longitudinal axis defining planes intersecting said first plane at substantially 90 degrees on either side of said first plane.

8. A luminaire optical system as in claim 2 wherein each of said second reflectors includes two arc segments joined at a middle apex.

9. A luminaire optical system as in claim 1 wherein said middle apex and said lamp longitudinal axis of each of said second reflectors define a plane intersecting said first plane at substantially 45 degrees on either side of said first plane.

10. A luminaire optical system as in claim 1 including a housing adapted to hold said lamp, first reflector assembly and second reflector assembly in fixed relationship thereto.

11. A luminaire optical system as in claim 10 wherein said housing is adapted to suspend from a ceiling.

12. A luminaire optical system as in claim 1 wherein said second reflectors include translucent areas.

13. A luminaire optical system as in claim 1 wherein said second reflectors include perforated areas.

14. A luminaire optical system as in claim 1 wherein said tubular lamp is a tube having a diameter of ⅝ inches (equivalent to approximately 1.5875 cm).

15. A luminaire optical system as claim 5 wherein said first reflector assembly first apex is positioned some 1 and ¾ inches (equivalent to approximately 4.445 cm) from said tube longitudinal axis.

16. A luminaire optical system as claim 5 wherein preferably said second reflector assembly second apex is positioned some 1 and ⅛ inches (equivalent to approximately 2.8575 cm) from said tube longitudinal axis.

17. A luminaire optical system as in claim 1 wherein said first reflector assembly has a footprint substantially greater than said second reflector assembly.

18. A luminaire optical system as in claim 6 wherein the reflection angle of said first reflectors is some 70 degrees from vertical at the first apex and some 125 degrees from vertical at said first distal edge.

19. A luminaire optical system as in claim 2 wherein the reflection angle of said second reflectors is some 117.5 degrees from vertical at the second apex and some 11.25 degrees at said second distal edge.

20. A luminaire optical system as in claim 1 wherein said middle apex is generally in the range of some 3–40 degrees.

* * * * *